United States Patent [19]

Jellen

[11] Patent Number: 4,481,743

[45] Date of Patent: Nov. 13, 1984

[54] SYSTEM AND METHOD FOR CONSTRUCTING WALLS AND FOUNDATIONS EMPLOYING STRUCTURAL COMPONENTS

[76] Inventor: Stephen F. Jellen, 1421 N. 2nd St., Edwardsville, Ill. 62025

[21] Appl. No.: 337,686

[22] Filed: Jan. 7, 1982

[51] Int. Cl.[3] ..... E04B 1/343

[52] U.S. Cl. ..... 52/64; 52/126.4; 52/127.12; 52/745; 414/11

[58] Field of Search ..... 52/122.1, 122.5, 126.1, 52/126.3, 127.7, 127.12, 293, 298, 708, 126.4, 64, 745; 414/10, 11, 12; 160/40, 206; 104/139, 140, 245, 258; 105/217

[56] References Cited

U.S. PATENT DOCUMENTS

| | | | |
|---|---|---|---|
| 703,705 | 7/1902 | Lockwood | 52/64 |
| 1,648,971 | 11/1927 | Swedenborg | 52/143 |
| 2,660,127 | 11/1953 | Boyko et al. | 104/40 |
| 2,746,540 | 5/1956 | Dixon | 160/206 |
| 2,886,174 | 5/1959 | Chasteney et al. | 52/126.4 |
| 2,915,115 | 12/1959 | Reynolds | 160/40 |
| 2,937,398 | 5/1960 | Latham | 160/206 |
| 3,141,207 | 7/1964 | Kahler | 52/64 |
| 3,335,532 | 8/1967 | Greenbie | 52/122 |
| 3,422,878 | 1/1969 | Galietti | 160/206 |
| 3,583,322 | 6/1971 | Vykukal | 104/139 |
| 3,726,053 | 4/1973 | Filipek et al. | 52/745 X |
| 3,807,532 | 5/1974 | Molt | 104/258 |
| 3,827,196 | 8/1974 | Voegeli | 52/64 |
| 3,887,083 | 6/1975 | Baxter | 214/1 H |
| 3,887,085 | 6/1975 | Baxter | 214/1 H |
| 3,979,864 | 9/1976 | Tillie | 52/122 |
| 4,034,524 | 7/1977 | Fromme et al. | 52/122 |
| 4,035,965 | 7/1977 | Ronai | 52/66 |
| 4,103,463 | 8/1978 | Dixon | 52/122 |
| 4,110,952 | 9/1978 | Blachura | 52/745 |
| 4,290,246 | 8/1981 | Hilsey | 52/169.1 |

FOREIGN PATENT DOCUMENTS

| | | | |
|---|---|---|---|
| 7820 | of 1896 | United Kingdom | 52/64 |
| 644254 | 10/1950 | United Kingdom | 52/745 |
| 1032784 | 6/1966 | United Kingdom | 52/745 |
| 1199373 | 7/1970 | United Kingdom | 52/126 |

*Primary Examiner*—Alfred C. Perham

*Attorney, Agent, or Firm*—Haverstock, Garrett & Roberts

[57] ABSTRACT

A system and method for erecting walls and foundations upon a base support from structural components, including a track assembly secured to a base support, a plurality of carrier assemblies each engagable with the track assembly to permit movement of the carrier assembly along the track assembly, each carrier assembly including a component engaging assembly for engaging a component, the carrier assembly adapted to be movable when a structural component is engaged therewith to a desired location along the track assembly, and adjusting means operable when the carrier assembly and the structural component engaged therewith have been moved to the desired location to prevent further movement of the carrier assembly along the track assembly and to secure the carrier assembly and the structural component engaged therewith in place at the desired location along the track assembly.

34 Claims, 13 Drawing Figures

2
2
12
14
16
18
20
22
24
26
28
29
30
32
44
46
68
70
80
85
86
90
92
106
108
109
116

SYSTEM AND METHOD FOR CONSTRUCTING WALLS AND FOUNDATIONS EMPLOYING STRUCTURAL COMPONENTS

The present invention relates to a system and method for constructing walls and foundations employing structural components, and more particularly to a system and method of constructing building foundations for residential homes, commercial buildings, and other structures from precast concrete foundation panels. The subject system and method may also be utilized to position and place a wide variety of structural components, such as internal wall panels, columns, arch halves for assembling arches, grill work, walls for swimming pools, and other components, and is not limited to concrete components, but may have application to other materials as well.

Presently, building foundations are generally constructed at the job site by erecting concrete forms at the location where the foundation is desired, pouring wet concrete into the forms, allowing the concrete to dry and harden, and then removing the forms. A foundation constructed in this manner requires time to erect the forms, access to the forms by heavy equipment such as concrete trucks, time to allow the concrete to dry and harden, and the removal of forms before the foundation is completed. In some instances it may be difficult, or even impossible, to comply with such requirements. For example, because of topographical or other constraints, it may not be feasible for heavy equipment, such as a concrete truck, to be able to gain access to the entire foundation location. In such a situation costly hand labor may then be required to transport the concrete from the truck to the forms. In other instances moisture conditions or various time or manning factors may also present difficulties.

To some extent some of the time and manning difficulties have been dealt with with varying degrees of success by employing precast concrete wall panels or other components for constructing the building foundation. However, the use of such precast concrete wall panels has not resolved all difficulties. Because such panels are generally large, bulky, and quite heavy, the use thereof has still required that access be generally available by heavy equipment to every portion of the foundation being constructed. If topographical or other conditions preclude access to the entirety of the foundation site, the use of such precast panels is greatly restricted. In addition, the use of such panels has typically required that various bracing means be employed during positioning and assembly of the panels to form a wall or foundation, and the placement of such bracing means, along with the manpower requirements therefor and for moving and positioning the panels themselves, have been drawbacks that have hampered the acceptance of walls and foundations formed and constructed from precast panels.

The system and method of the subject invention eliminate, for the most part, the time consuming steps attendant with poured concrete foundations, and provide for efficient and effective placing and securing of precast concrete wall panels and other similar components onto primary footings for constructing residential homes, small buildings, and/or the foundations thereof, without requiring extraneous bracing means and without requiring total accessibility to the foundation site by heavy equipment. The present invention resides in a system and method for receiving structural wall components that have been transported to a building foundation site, for thereafter transporting and moving such components at the building site to desired points upon the foundation footings, and for ultimately securing such components into position at such points. In a preferred embodiment the system includes carrier assemblies adapted to engage a track assembly or guidance means secured to, cast in, or otherwise associated with the foundation footings, and such carrier means are further adapted to permit precast concrete foundation wall panels to be mounted thereon and secured thereto for transport thereby to desired points along the foundation footings, and to thereafter themselves be secured into position, along with the concrete panels mounted thereon, at such desired points.

In one embodiment described hereinafter the guidance means includes a continuous generally U-shaped channel means secured to or cast into the top of footings around the perimeter of the structure to be erected and having inwardly projecting flanges disposed on either side of a longitudinal slot or opening extending along the top thereof. Typically, such channel means is constructed to have gradual curves at the corners of the footings so that the roller carriers and the precast panels that may be mounted thereon may be easily rolled around the corners of the footings to any position along the periphery thereof. The carrier assemblies of such embodiments are constructed to include rollers or wheels which may be inserted into and retainably positioned in the channel means for rotational movement therein longitudinally therealong, and each such carrier assembly includes a panel engaging portion adapted to engage a complementary socket assembly formed in a concrete panel and to secure such panel to the carrier assembly such that the panel may be vertically supported thereon for movement along the channel means to a desired location. A preferred panel engaging portion of the carrier assembly includes a vertical columnar stud having a laterally extending compressible member located at the top thereof, which stud and compressible member are insertable through an exteriorly threaded tubular sleeve which is shorter than the vertical columnar stud and which is adjustable when mounted surrounding the vertical columnar stud to engage complementarily threaded means associated with or installed within the socket assembly of the panel.

When the precast panels have been mounted on the carrier assemblies and the carrier assemblies with the precast panels mounted thereon have been positioned at desired locations upon the footings, leveling bolts positioned along the undersides of the panels may be adjusted to level and position the precast panels upon the footings, and the threaded sleeves of the carrier assemblies may thereafter be further adjusted so that the top surfaces thereof vertically engage and act upon the bottom surfaces of the laterally extending compressible members located at the tops of the vertical columnar studs of the panel engaging portions of the carrier assemblies. Such adjustment causes the rollers or wheels of the carrier assemblies to be lifted out of engagement with the base of the channel means and into tight engagement with the undersides of the inwardly projecting flanges thereof in order to secure the carrier assemblies and the panels mounted thereon in place at such points. Once all of the carrier assemblies and panels have thus been located and secured in position the panels are grouted into place and a permanent connection is thus established between and among the precast panels and the footings.

Although movable wall partitions and panels have been well known for many years, as has been described in U.S. Pat. No. 4,103,463, and although various means have been known for assembling and conveying wall panels from place to place, as is reflected in U.S. Pat. No. 3,979,874, and for moving wall partitions on wheeled devices, including means such as those disclosed in U.S. Pat. Nos. 3,335,532; 4,034,524; and 4,035,965, no known devices or systems have been constructed or designed to operate in a manner such as is described herein to construct building foundations, and, especially, building foundations from structural components. For the most part, improvements in the use of prefabricated or precast structural components have been directed to the components themselves or to means for moving or repositioning individual components or building walls, as can be seen from U.S. Pat. No. 4,290,246 and the patents cited hereinabove, or to means for moving prefabricated units onto already constructed foundations, as is disclosed in U.S. Pat. Nos. 3,887,083 and 3,887,085, and not to the construction of building foundations themselves and to systems and methods for use in such construction. The present invention represents an advance and improvement in such construction and in the system and method used in such construction, and provides and achieves the various advantages discussed herein.

It is therefore a principal object of the present invention to provide improved means for constructing a wall or foundation from prefabricated or precast components.

Another object is to provide improved means for moving prefabricated or precast components during the erection of a structure.

A further object is to provide improved means for securing prefabricated or precast components into place in a structure.

A still further object is to provide an efficient and economical system for locating prefabricated or precast panels in a construction project without requiring access to all parts of the construction site by heavy construction equipment.

It is a further object to provide an efficient and economical system for both moving and securing prefabricated or precast panels into place in a building project.

Another important object is to provide a system for erecting prefabricated or precast components in a structure in which little or no biasing or outside support means is needed to hold up the prefabricated or precast components while they are being moved into place.

A further important object is to teach a method of constructing a wall or foundation using prefabricated or precast structural components and without the necessity of employing external bracing members.

Another object is to teach a method of constructing a wall or foundation using prefabricated or precast structural components by employing component movement means that become incorporated within such wall or foundation as a part thereof.

A still further object is to teach a method of employing means for moving prefabricated or precast structural components to selected points and securing such means and components in place to form walls and foundations.

Another important object is to teach the construction of walls or foundations from structural components and with minimal hand labor.

It is also an object to teach the construction of walls or foundations from structural components and from means engagable therewith for easily moving, positioning, and securing such components into place.

These and other objects and advantages of the present system and method will become apparent after considering the following detailed specification in conjunction with the accompanying drawings, wherein.

Figures 1, 12:
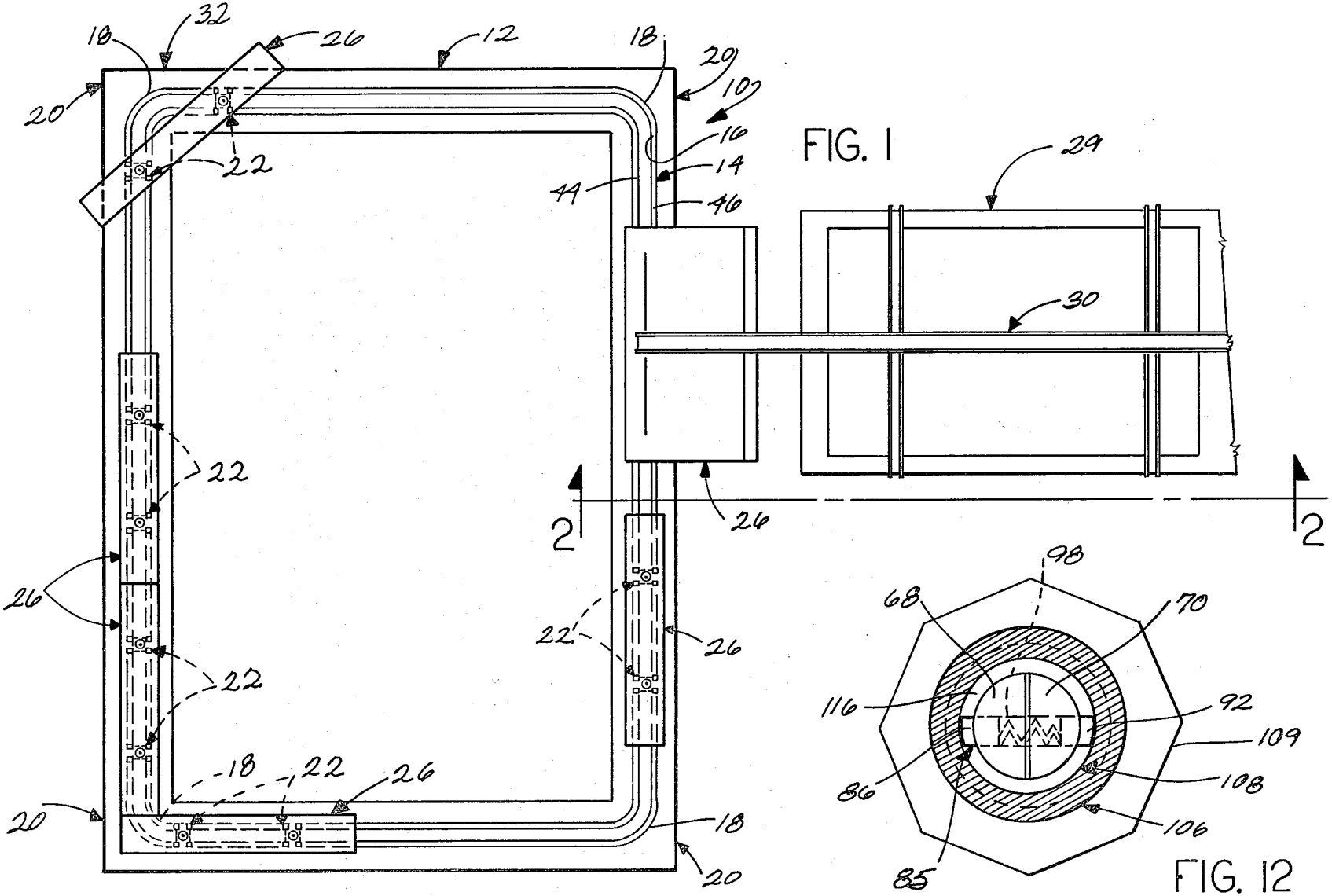
FIG. 1 is a top plan view of a construction site showing a building foundation being constructed according to the present invention.
Figure 11:
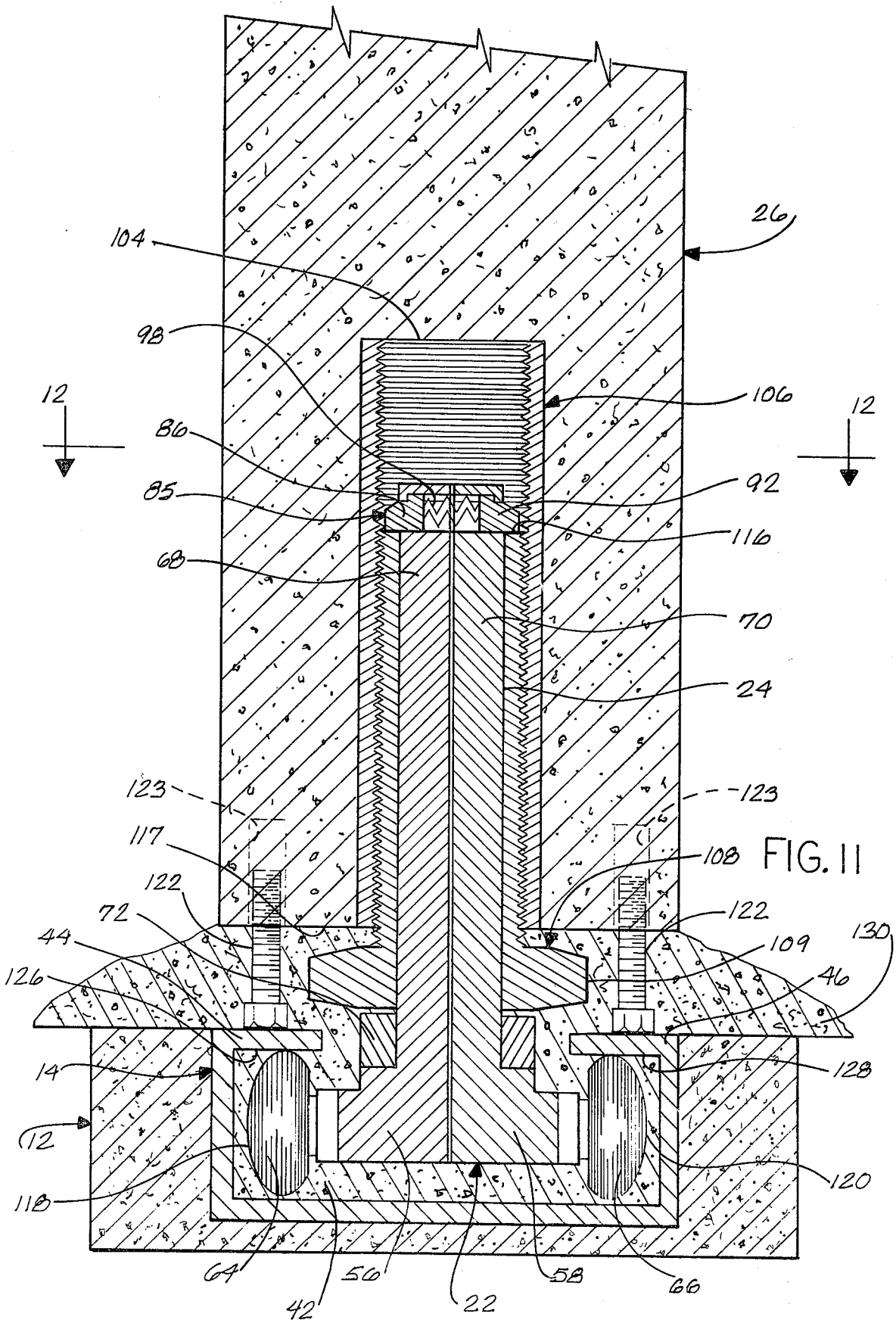
Figure 13:
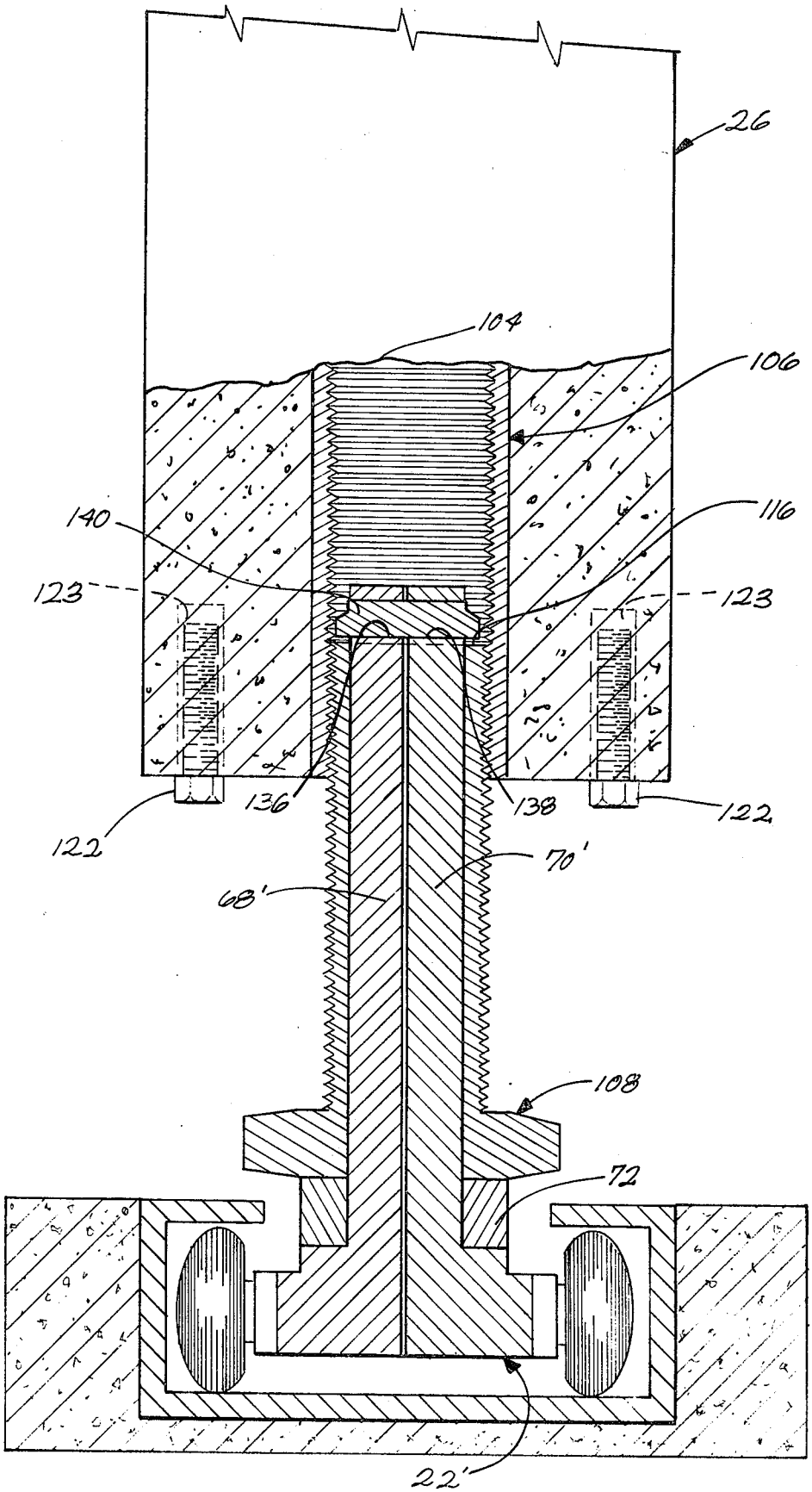

FIGS. 8, 9, 10, and 11 are sectional views of a carrier assembly and an associated precast foundation panel member, depicting, sequentially, the positioning and engagement of the foundation panel member on and by the carrier assembly, and the subsequent placement and installation of the engaged assembly and panel member at a selected location upon the building footing;

FIG. 12 is a top plan view of a portion of the carrier assembly of the invention taken along line 12—12 of FIG. 11; and, FIG. 13 is a cross-sectional view of an alternate embodiment of a carrier assembly engaging a precast panel member.

Referring to the drawings more particularly by reference number, wherein like numbers refer to like components, number 10 in FIG. 1 identifies a structure foundation being constructed according to the present invention. The foundation 10 includes footings 12 which are typically of concrete poured in place to support the foundation walls and the structure being erected thereon, which footings have a track or channel 14 secured on top thereof or cast thereinto. The channel 14, which is typically U-shaped with oppositely disposed inwardly projecting top flanges 44 and 46 and a central longitudinally extending slot 16 therebetween, is constructed to have gradual, curved portions 18 at the corners 20 of the footings 12. Such channel generally, although not necessarily, is constructed to extend around the entire outer perimeter of the structure to be erected. A plurality of carrier assemblies 22, the description and importance of which will be discussed in greater detail hereinafter, are shown installed in the channel 14 and supporting precast foundation members 26 by means of panel engaging portion 24 (FIG. 2) thereof which projects upwardly out of the channel 14 through slot 16 to engage the precast panel members 26, as will be further explained hereinafter.

Figure 4:
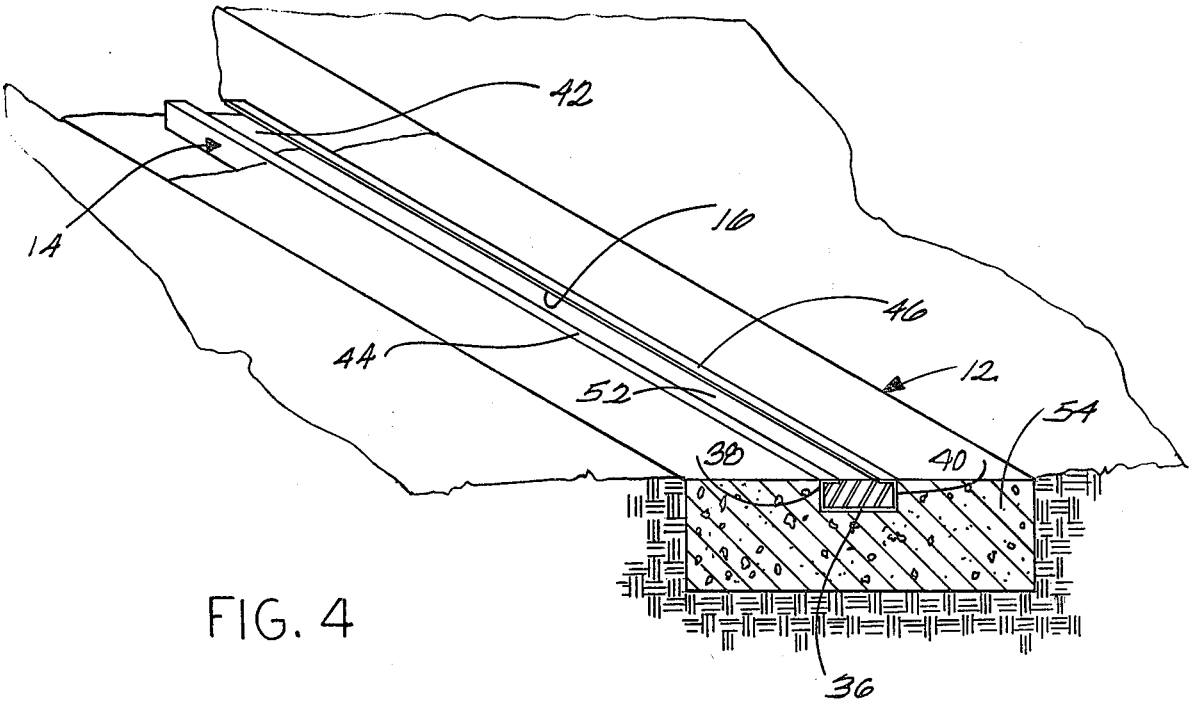
FIG. 4 is a fragmentary sectional perspective view showing the channel member of FIG. 3 from a different angle after the footings have been poured.
Figure 3:
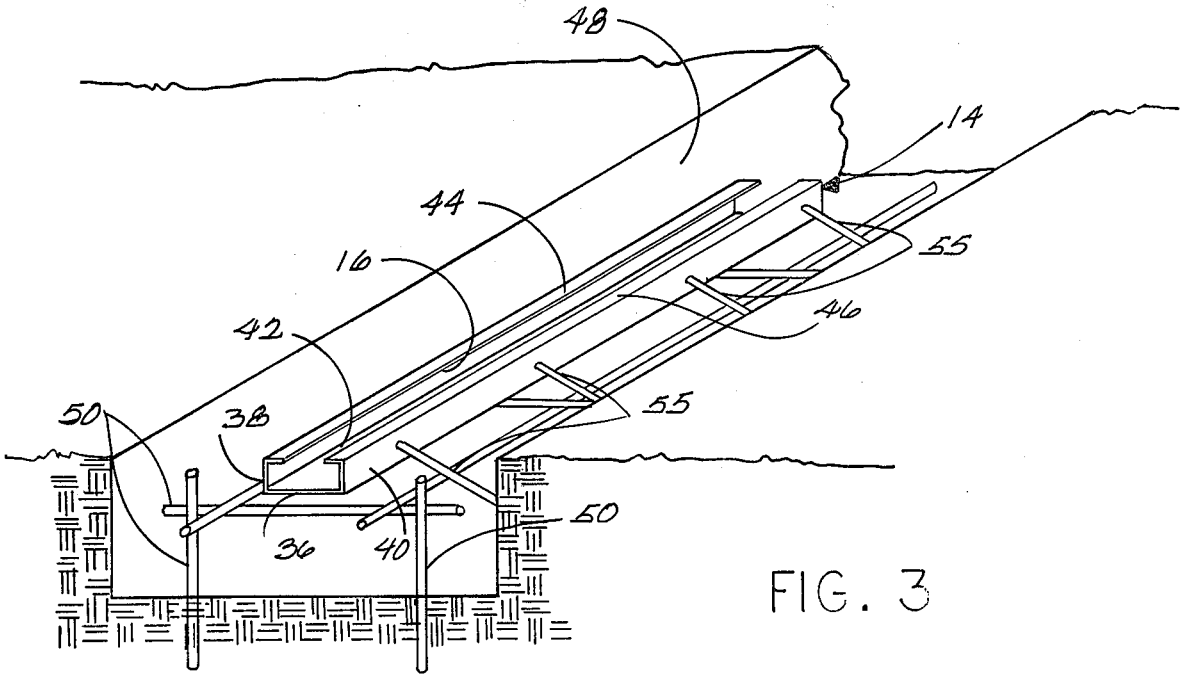
FIG. 3 is a fragmentary sectional perspective view of a portion of the channel member of the invention in a trench preparatory to pouring the footings of a structure built in accordance with the present invention.

Although channel 14 may take any of a variety of forms and may be secured to, cast in, or associated with the footings 12 in any of a variety of ways, FIGS. 3 and 4 depict a preferred channel embodiment and one manner of positioning and securing such channel to the footings 12. The channel 14 of FIGS. 3 and 4 has a generally U-shaped cross-section with a bottom 36, side walls 38 and 40 forming an elongated trough 42 along the length of the channel 14, and oppositely disposed inwardly projecting flanges 44 and 46 attached to the tops of side walls 38 and 40, respectively, and defining a central longitudinally extending slot 16 therebetween. The channel 14 is inserted in an excavation 48 having a size and shape desired for the footings 12, and is positioned and leveled along the top of the excavation 48 by members such as tie rods 50. Stabilizing means 55, which may take any of a variety of forms, such as lugs or steel rods welded or otherwise attached to channel 14 as shown in FIG. 3, may also be employed for reasons which will become apparent from what follows. A protection member 52 (FIG. 4), such as a styrofoam block, a pnuematic hose, foam rubber, or a plastic or other covering, may be employed within center trough 42 of channel 14 in order to prevent foreign material such as dirt or concrete from falling or flowing into the center trough 42 during the pouring of the footings 12. Once the set-up of channel 14 is completed concrete mixture 54 is poured into the excavation 48 around channel 14 and stabilizing means 55. If channel 14 has been properly leveled during set-up the top of the channel may then be easily utilized as a guide to strike off the top of the footings to elevation. As the concrete hardens to form the footings 12, channel 14 and stabilizing means 55 are locked in place in the footings, and the then embedded stabilizing means will thereafter act to prevent channel 14 from being twisted out of the footings 12 as the precast panels 26 are moved around the channel, as will be explained.

The channel 14 could alternatively be secured to the top of the footings 12 by separate attachment means, such as by bolts or other known means, instead of being cast into the footings. However, the embodiment shown in FIGS. 3 and 4, wherein the channel 14 is embedded within the footings 12, is preferred because it provides a solid interconnection between and among channel 14, stabilizing means 55, and footings 12, and is more resistant to torsional forces that could tend to twist or pull the channel away from the footings as the carrier assemblies with panels mounted thereon are moved along the channel.

After the concrete mixture 54 hardens, protection member 52 in the center trough 42 of the channel 14 may be removed to provide a continuous open channel around the periphery of the construction site on the footings 12, as shown in FIG. 1, and the various carrier assemblies may be installed in the channel.

Figure 5:
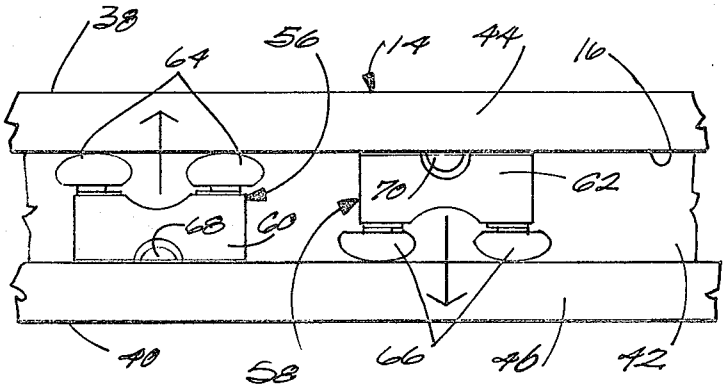
FIGS. 5, 6 and 7 show top plan views of a carrier assembly being inserted within a channel member of the present invention.
Figure 6:
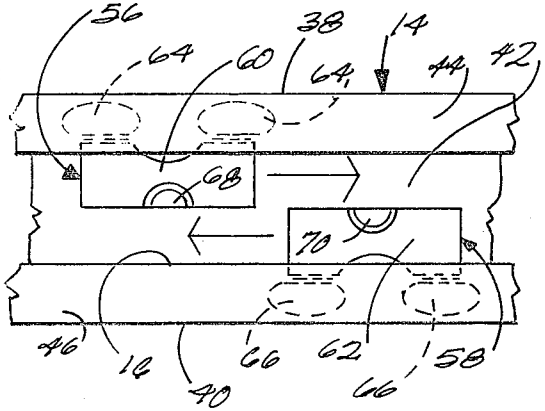
Figure 7:
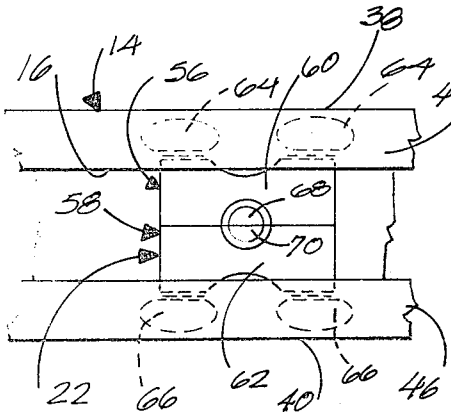

As may be best seen in FIGS. 5–11, each carrier assembly 22 includes a complementary pair of like body assemblies 56 and 58, each of which has two unpaired wheel members attached thereto. As is shown more clearly in FIGS. 8–11, the carrier body assemblies 56 and 58 have respective base portions 60 and 62, respective wheel members or rollers 64 and 66, and respective vertical half columnar stud portions 68 and 70 that extend upwardly from the respective base portions 60 and 62. The body assemblies 56 and 58 are each sized such that they can be individually inserted through the opening 16 in the channel 14 into the open trough 42 therein, as shown in FIG. 5, and thereafter moved outwardly such that their wheel members are positioned adjacent opposite side walls 38 and 40 of the channel 14 and disposed beneath opposed flange members 44 and 46, as depicted in FIG. 6. Assembly of each carrier assembly is then completed by movement of the body assemblies 56 and 58 into side-by-side alignment within channel 14, as is shown in FIG. 7, and the securing of the body assemblies 56 and 58 to one another by any suitable means.

In the preferred embodiment of carrier assembly depicted in FIGS. 8–11, the upwardly projecting vertical half columnar stud portions 68 and 70 have respective corresponding stepped transverse keyways 78 and 82 located near their distal ends 80 and 84, respectively, for receiving and retaining a laterally compressible key assembly 85, including slidable key members 86 and 92 and a centrally disposed spring 98 therebetween, when the carrier body assemblies 56 and 58 are in side-by-side engagement with one another. Key members 86 and 92 are slidably positioned in respective keyways 78 and 82 and have enlarged tab portions 88 and 94 which are disposed within the larger portions of the stepped transverse keyways 78 and 82 and are sized to prevent the passage thereof through respective reduced keyway portions 90 and 96. Such key members may thus be slidably moved inwardly in such keyways against the centrally disposed spring 98, but their outward travel is limited so that they cannot pass entirely through and be withdrawn from such keyways.

Figure 8:
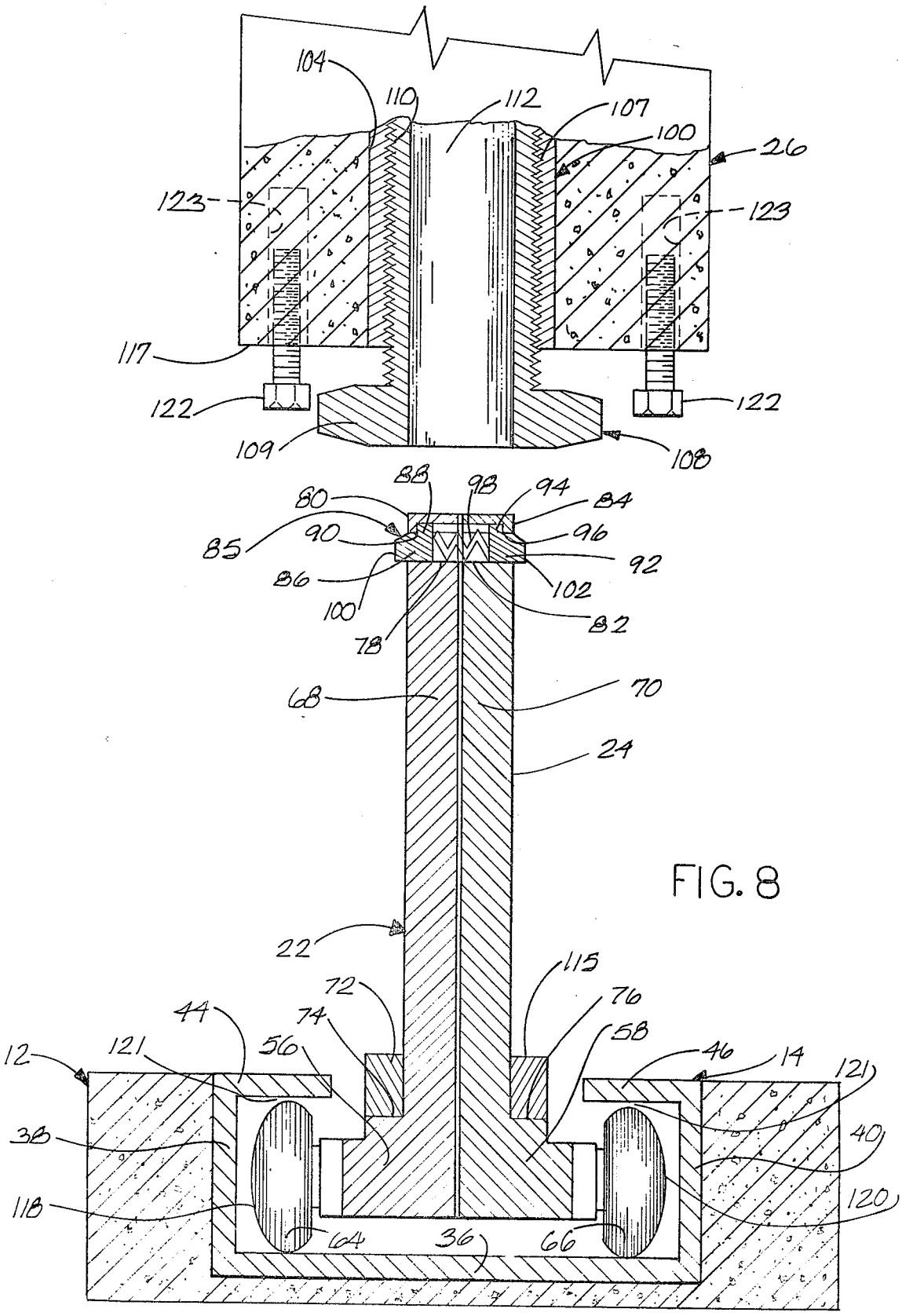

During assembly of the individual carrier assemblies 22, as depicted in FIGS. 5–7, spring 98 is positioned between the key members 86 and 92 in the keyways 78 and 82 to bias the key members outwardly such that their outer ends 100 and 102, respectively, normally extend beyond the outer surfaces of the respective upwardly projecting vertical half columnar stud portions 68 and 70. A bearing collar 72 is then positioned around the upwardly projecting vertical half columnar stud portions 68 and 70 and moved downwardly past the laterally compressible key assembly 85 to bear upon surfaces 74 and 76 of carrier body assemblies 56 and 58 (FIG. 8). Key members 86 and 92 are preferably beveled at their upper outer corners to facilitate compression of the key assembly 85 whenever the bearing collar 72 engages the key assembly 85 as such collar is pushed downwardly about the upwardly projecting vertical half columnar stud portions 68 and 70 of the carrier body assemblies 56 and 58. Such beveling also facilitates engagement between the carrier assemblies 22 and the panels 26, as will be further explained hereinafter. When the bearing collar 72 has been properly positioned to secure the body assemblies 56 and 58 to one another the resulting assembly of upwardly projecting vertical half columnar stud portions 68 and 70 and key assembly 85 defines a panel engaging portion 24 of carrier assembly 22 which is employed with cooperatively engagable means of the panels 26 to effect interengagement therebetween and the mounting of such panels upon the carrier assemblies for support and movement thereof to desired locations.

As may be best seen from FIGS. 8–11, the panels 26 preferably include spaced cylindrically shaped holes or sockets 104 cast into the bases 117 thereof, with at least one such hole or socket associated with each end thereof, and adapted to be lined with tubular metal liner 106 having internal threads 107. With such a configuration a tubular sleeve 108 having an adjusting nut portion 109 at one end, external threads 110 adapted for engagement with threads 107, and a smooth longitudinal bore 112 therethrough, may be threadedly engaged with and screwed into the liner 106 to form a means for engaging the panel engaging portion 24 of the carrier assembly. Tubular sleeve 108 is preferably dimensioned such that its length is less than the distance between the bottom edge of key assembly 85 in panel engaging portion 24 and the top surface 115 of bearing collar 72 when such collar is disposed against surfaces 74 and 76 of the carrier body assemblies 56 and 58. The reason for such sizing will become apparent in the discussion that follows. The panels 26 also preferably include a plurality of threaded leveling bolts 122 cooperatively engagable with internally threaded cavities 123 extending into the panels from the bases 117 thereof, the purpose and function of which will become apparent hereinafter.

Figure 2:
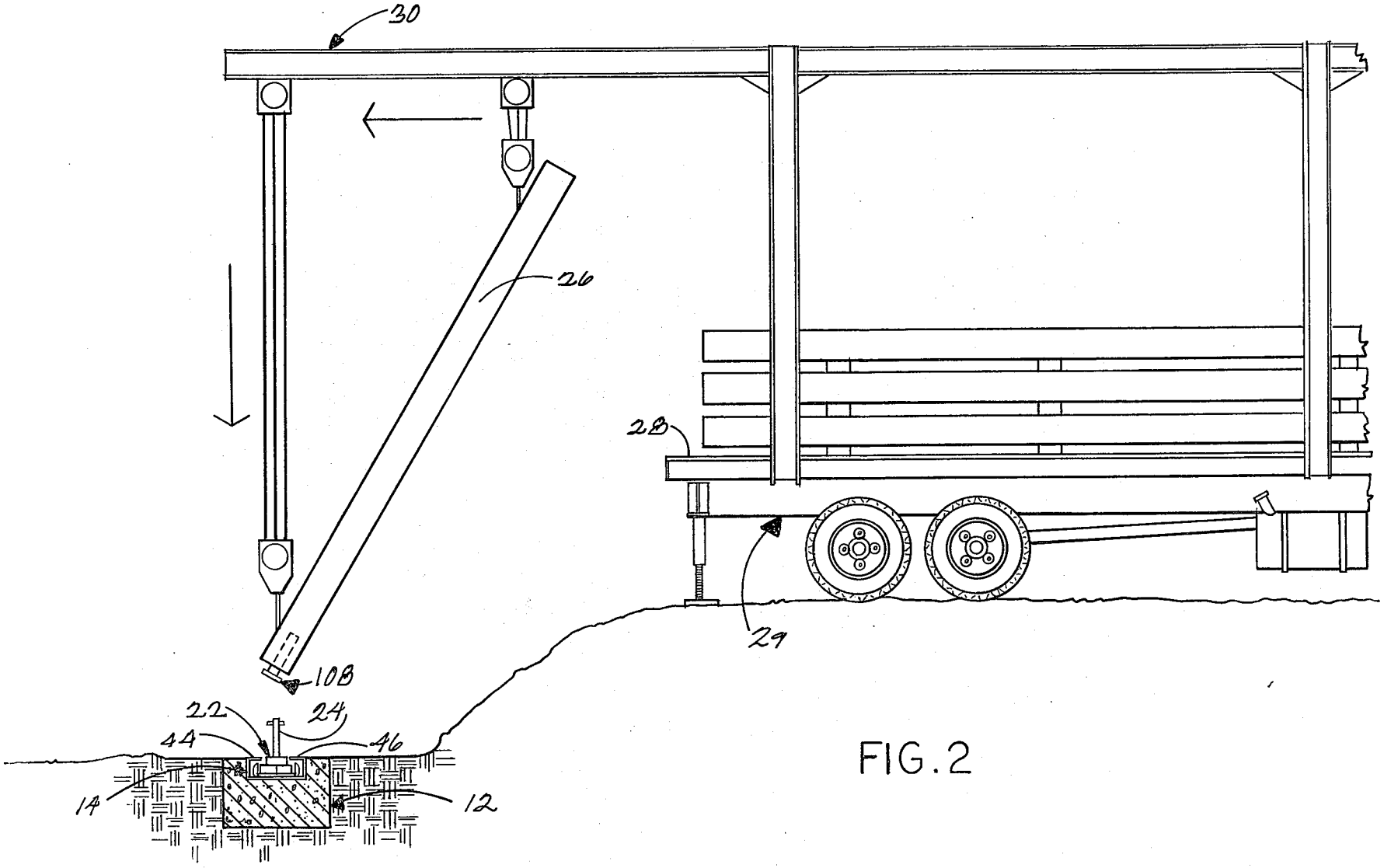
FIG. 2 is a side elevational view of a portion of FIG. 1 taken along lines 2—2 showing a precast foundation panel member being unloaded from a truck and positioned on a carrier assembly employed in the present invention.

With such panels 26, and with the carrier assemblies 22 retainably, yet laterally movably, disposed within channel 14, it is then possible to construct a building foundation from precast concrete panels, and to do so with relative ease, with minimal manual labor, without the necessity of employing external bracing means, and without requiring access by heavy equipment to all parts of the foundation site. This is accomplished, as is best shown in FIGS. 1 and 2, by positioning a truck 29 loaded with precast concrete panels adjacent to an accessible site along the building footings, positioning carrier assemblies 22 within the channel 14 at such location, unloading the panels 26 from the bed 28 of truck 29 by means such as overhead hoisting apparatus 30, and lowering such panels until the panel engaging portions 24 of the carrier assemblies are in vertical alignment with sockets 104 and their associated metal liners 106 and tubular sleeves 108. At such time the tubular sleeves 108 of the panel 26 being handled should be partially backed out of lined sockets 104 by adjustment of adjusting nut portion 109, and the resulting configuration will then be similar to that depicted in FIG. 8.

Figure 9:
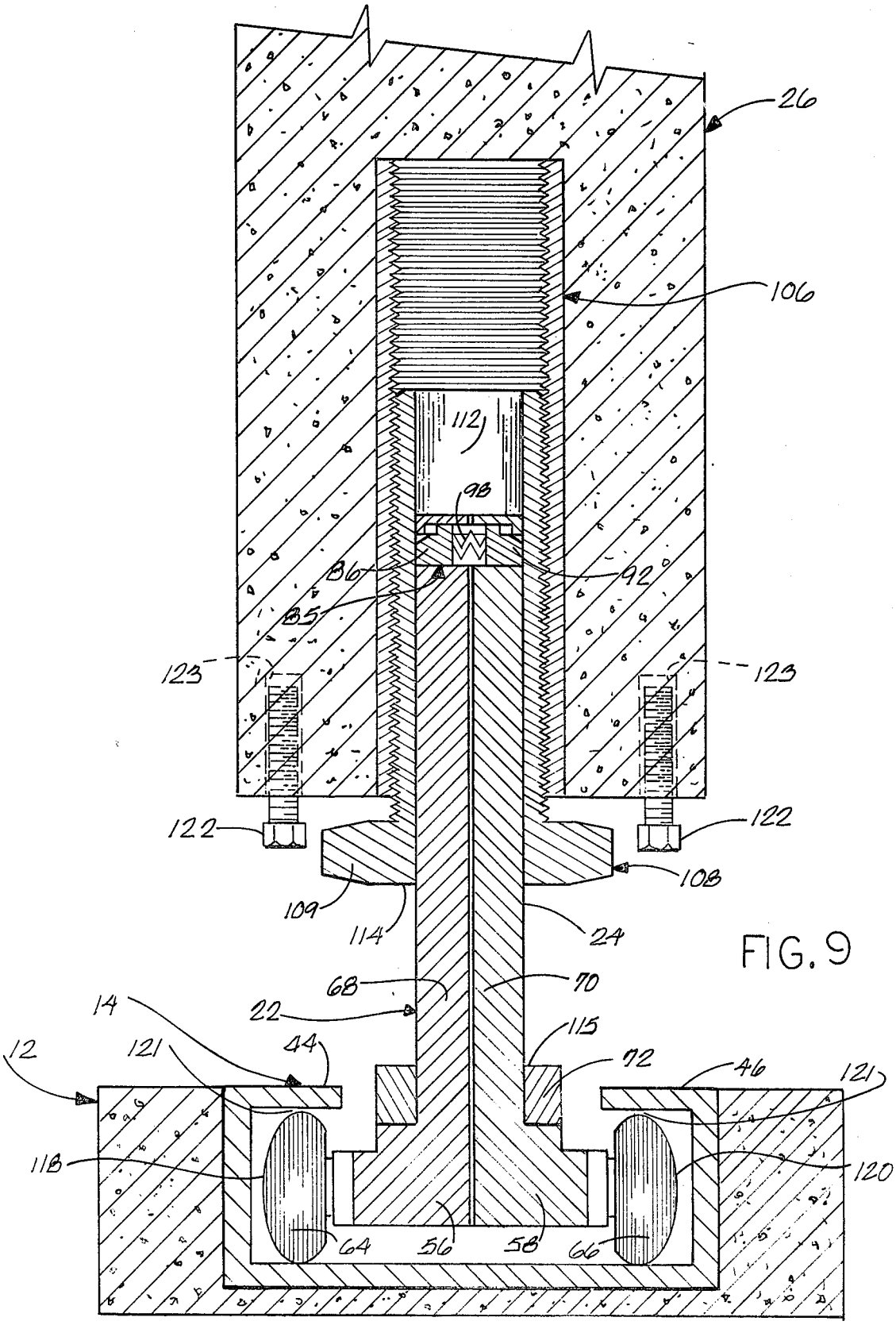
Figure 10:
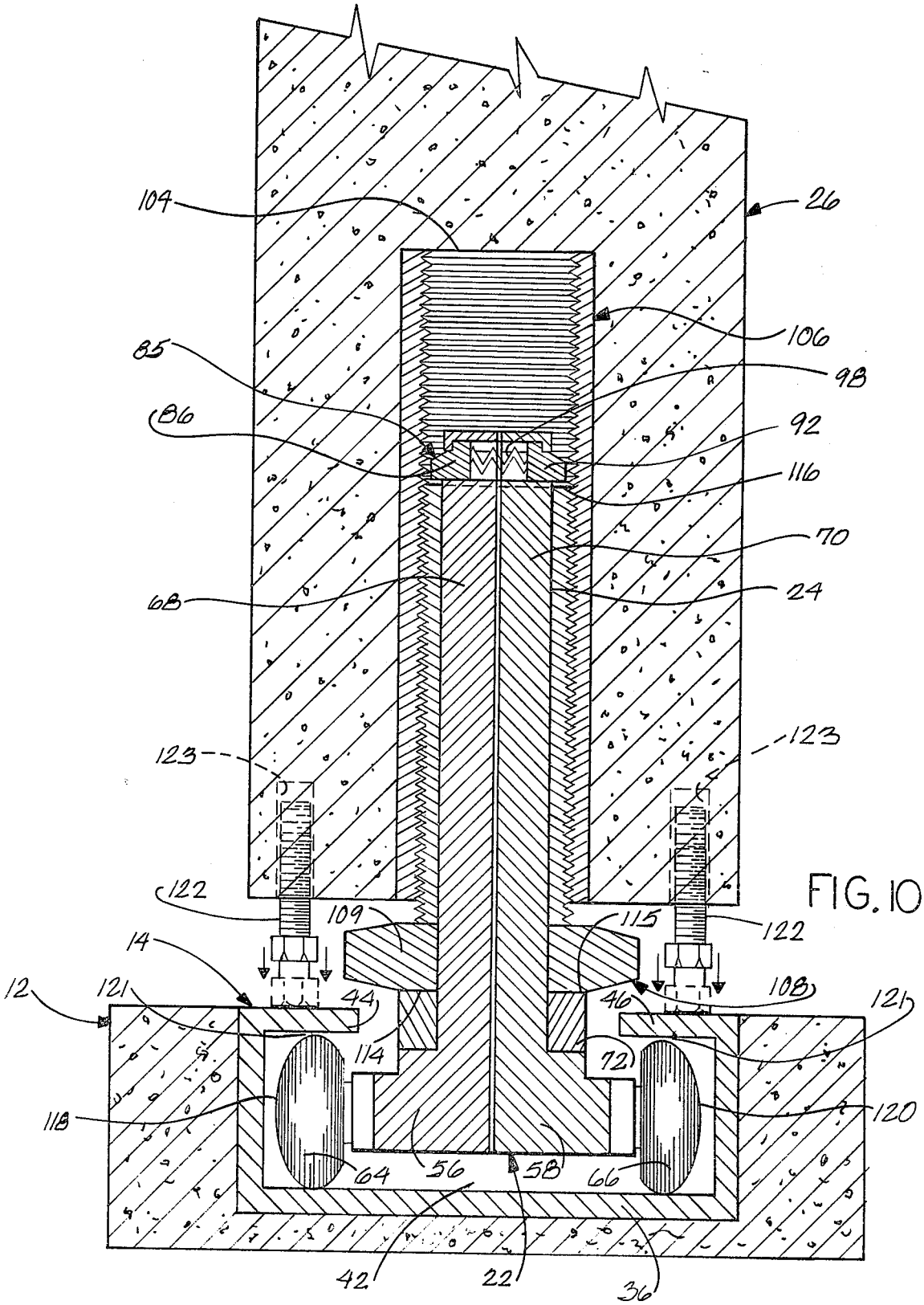

Once such configuration has been attained the panel 26 is further lowered such that panel engaging portion 24 of carrier assembly 22 enters bore 112 of tubular sleeve 108, as shown in FIG. 9. As has been previously noted, the upper outer corners of the key members 86 and 92 of key assembly 85 are beveled, with the result that key assembly 85 is laterally compressed when tubular sleeve 108 engages the key assembly, thereby permitting panel engaging portion 24 to easily penetrate and move through bore 112 of tubular sleeve 108 as panel 26 is lowered. The lowering of panel 26 continues until the bottom surface 114 of adjusting nut portion 109 of the tubular sleeve 108 engages the top surface 115 of bearing collar 72, and at this point the weight of panel 26 is transferred from the overhead hoisting apparatus 30 to the carrier assemblies 22 engaging such panel. During the process of lowering a panel 26 into position on a carrier assembly 22 the key assembly 85 thereof will have passed completely through bore 112 of tubular sleeve 108, and, upon completion of such passage, spring 98 will have caused key members 86 and 92 to return to their normal outwardly biased positions in which they extend beyond the outer sides of upwardly projecting vertical half columnar stud portions 68 and 70 and also project beyond the inner wall of tubular sleeve 108 above the top end 116 thereof, as is depicted in FIG. 10. Such action locks the tubular sleeve 108 on the panel engaging portion 24, and since tubular sleeve 108 is threadedly engaged with metal liner 106 in socket 104 of panel 26, the end result of such action is to effect engagement between panel 26 and the carrier assembly 22 that will thereafter support such panel. It will be recognized from what has been described hereinabove that bearing collar 72 is appropriately dimensioned and engagable with the carrier body assemblies 56 and 58 such that, when the carrier assembly 22 is disposed within channel 14 in a normal movable mode with its roller or wheel members 64 and 66 resting upon the bottom 36 of such channel, the top surface 115 of such collar is disposed above the elevation of the flanges 44 and 46 of the channel. This prevents adjusting nut portion 109 from contacting and dragging upon flanges 44 and 46 during any periods of adjustment and permits relatively easy access to adjusting nut portion 109.

When the panel 26 has been mounted upon carrier assemblies 22 and is supported thereby, as is depicted in FIG. 10, the panel may be disengaged from the overhead hoisting mechanism, and the carrier assemblies with their mounted panel may then be moved along channel 14, as depicted in FIG. 1, to position such panel at a desired location upon footings 12. The curved portions 18 of channel 14 are dimensioned to permit the carrier assemblies 22 to roll through the curves without binding or jamming, and the outer surfaces 118 and 120 of roller or wheel members 64 and 66 are preferably of a convex shape to facilitate movement along the insides of such curves. It will be observed that the upward projecting vertical half columnar stud portions 68 and 70 are designed to fit together and to be jointly rotatably movable within and with respect to tubular sleeve 108. Such rotational movement is further facilitated by bearing collar 72 which is disposed between the surfaces 74 and 76 of the carrier assembly 22 and the adjusting nut portion 109 of tubular sleeve 108. Thus, as the carrier assemblies negotiate the curved portions 18 of channel 14 they rotate about the vertical axis of the panel engaging portion 24 relative to the panel 26 supported thereby, as is depicted at corner 32 in FIG. 1, and the panels 26 can thus be easily moved about the entire building periphery along channel 14.

As has already been noted, the outer surfaces 118 and 120 of the wheels 64 and 66, respectively, are arcuate to facilitate movement of the carrier assemblies 22 through the curved portions 18 of channel 14. Preferably, such outer surfaces have a radius of curvature less than the radius of the curved portion 18 of the corners 20, and the roller or wheel members 64 and 66 are sized such that there is only a small clearance 121 between them and the respective flanges 44 and 46. With such a preferred wheel member construction the carrier assemblies can be easily moved, even when loaded with a panel, along the channel 14, including through curved portions 18 thereof, without the mounted panel tipping or toppling over and falling. This is due in large part to the ability of the herein described system to maintain the panel being moved in an essentially upright position above and supported by the carrier assemblies and to counteract lateral forces applied to the panel. The channel 14 is designed and acts to restrict undesired carrier assembly movements and to prevent toppling or overturning of such carrier assemblies. Because of the torsional forces that may be applied to the channel, however, such as by wind acting upon a face of the panel being moved, it is desirable that means such as stabilizing means 55 (FIG. 3) be employed to firmly anchor the channel 14 in place and prevent it from being twisted or torn out of footings 12.

Once a panel 26 has been moved to its desired, final, permanent position, leveling bolts 122 in the base 117 of such panel 26 are backed out of the threaded cavities in which they are inserted until they engage the upper surfaces of the flanges 44 and 46. Tubular sleeve 108 is then further screwed into the liner 106 until the weight of panel 26 is supported by the leveling bolts 122, which are then adjusted until the panel 26 is supported by the leveling bolts in a level and vertical condition.

At this point in the foundation construction the tubular sleeve 108 is screwed further into the metal liner 106 by turning the adjusting nut portion 109 until the sleeve top 116 engages the bottom surfaces of key members 86 and 92. Further screwing in of the tubular sleeve 108 will then cause the key members 86 and 92 to be lifted by sleeve top 116 acting against the bottom surfaces of such members, with the result that the panel engaging portion 24 and the entire carrier assembly 22 will be pulled upwardly until the roller or wheel members 64 and 66 thereof are lifted off of the bottom of channel 14 and pulled into tight engagement with the bottom surfaces 126 and 128 of the flanges 44 and 46, respectively. Such action locks the carrier assembly in place and thus secures the precast panel 26 mounted thereon to the footings 12, as is depicted in FIG. 11. Once panels 26 are properly positioned at desired locations the joints therebetween and between such panels 26 and the footings 12 are finished by injecting a sealant 130, such as grout or cement, into all joint openings, including between the footings 12 and the precast panels 26, into the trough 42 around the carrier assemblies 22, and between adjacent panels, to firmly lock such panels 26 and their supporting carrier assemblies into place. It can thus be seen that upon completion of the building foundation the carrier assemblies 22 and the channel 14 have become permanent parts of the connection between the precast panels 26 and the footings 12.

It will be appreciated that, while the foregoing describes a preferred embodiment of a system for constructing walls and foundations from precast concrete components, various changes and modifications may be made therein with respect to various components thereof. For example, FIG. 13 depicts a carrier assembly 22' wherein transverse keyways 136 and 138 which register with one another are provided through upwardly projecting vertical half columnar stud members 68' and 70', respectively. Unlike the stepped keyways 78 and 82 of FIGS. 8–11, keyways 136 and 138 are of uniform cross-section throughout and are adapted to have a solid key or pin 140 located therein and extending through the vertical half columnar stud members 68 and 70. When such embodiment is employed tubular sleeve 108 is inserted over the members 68' and 70' during carrier assembly and positioned such that adjusting nut portion 109 rests on bearing collar 72 with sleeve top 116 located below the keyways 136 and 138. Solid key 140 is then inserted through the keyways 136 and 138 to extend beyond the sides of members 68' and 70' and so retain tubular sleeve 108 on members 68' and 70'. Once such assembly has been completed, precast panel 26, with no tubular sleeve 108 inserted into and engaged with metal liner 106 of cavity 104, is lowered into place over the carrier assembly 22' and is aligned such that tubular sleeve 108 mounted upon the carrier assembly 22' may engage the liner 106 in the panel 26. As the panel 26 is further lowered tubular sleeve 108 is screwed into liner 106 by turning the adjusting nut portion 109 thereof, thereby effecting engagement of the panel 26 by carrier assembly 22'. Once the panel has been lowered to the desired position and suitably engaged by the carrier assembly 22', such assembly and the panel mounted thereon can be transported to a desired location upon the building footings and anchored into place, as has been previously described in connection with FIGS. 10 and 11.

It will be further appreciated that, in addition to the system embodiments described hereinbefore, other embodiments having various changes and modifications could be equally as well employed, including, for example, systems having gear or ratchet mechanisms or hydraulically controlled means associated with the roller assemblies and panels for effecting interengagement and adjustable movement therebetween, and such system embodiments may be similarly advantageously utilized according to the present invention to effect the easy and economical construction of walls and foundations from modular components. In light of all the foregoing, it will be recognized that there has been shown and described herein a novel system and method for constructing walls and foundations from precast concrete panels and other structural components, which system and method fulfill the various objects and advantages sought therefor. It will be apparent to those skilled in the art, however, that many changes, modifications, variations and other uses and applications for the subject device, beyond those discussed and described herein, are possible. All such changes, modifications, variations, and other uses and applications which do not depart from the spirit and scope of the invention are deemed to be covered by the invention which is limited only by the claims which follow.

What is claimed is:

1. A system for erecting walls and foundations upon a base support from preformed structural components, comprising guidance means including channel means formed in the base support, a plurality of individual carrier assemblies independently engagable with the guidance means and movable therealong when engaged therewith, each of said carrier assemblies including component engaging means for engaging a structural component when the structural component is mounted thereon, said carrier assembly being movable when a structural component is engaged therewith to a desired location along said guidance means, each of said carrier assemblies further including clamping-type securing means operable when said carrier assembly and the structural component engaged therewith have been moved to the desired location to prevent further movement of the carrier assembly along the guidance means, operation of said securing means effecting a tight clamping interengagement between said carrier assembly and said guidance means to secure the carrier assembly and the structural component engaged therewith in place at the desired location.

2. The system of claim 1 wherein said guidance means includes channel means having a base and opposed side walls, each of said side walls having an inwardly projecting flange near the top thereof, said flanges defining a longitudinal slot therebetween.

3. The system of claim 2 wherein said channel means includes a plurality of channel members assembled to form a continuous channel.

4. The system of claim 1 wherein said channel means includes a channel cavity within the base support, a channel member within said channel cavity, and stabilizer means therewith for securing said channel member within the base support.

5. A system for erecting walls and foundations upon a base support from preformed structural components, comprising guidance means secured to the base support, a plurality of individual carrier assemblies independently engagable with the guidance means and movable therealong when engaged therewith, each of said carrier assemblies including component engaging means for engaging a structural component when the structural component is mounted thereupon, said carrier assembly being movable when a structural component is engaged therewith to a desired location along said guidance means, each of said carrier assemblies further including clamping-type securing means operable when said carrier assembly and the structural component engaged therewith have been moved to the desired location to prevent further movement of the carrier assembly along the guidance means, operation of said securing means effecting a tight clamping interengagement between said carrier assembly and said guidance means to secure the carrier assembly and the structural component engaged therewith in place at the desired location, each of said carrier assemblies including a base portion engagable with said guidance means, said base portion including roller means for permitting movement of said carrier assembly along said guidance means, said component engaging means including a projecting portion extending upwardly from said base portion, said projecting portion being insertable into a socket assembly in a preformed structural component.

6. The system of claim 5, wherein said projecting portion includes an essentially cylindrical shaft having a transverse keyway therethrough near its distal end, key means insertable into said keyway, and sleeve means having a circular bore extending therethrough, said sleeve means being slidably mountable over said shaft and dimensioned such that said shaft extends through said circular bore of said sleeve means and projects therebeyond, said key assembly adapted to retain said mounted sleeve means upon said shaft, said mounted sleeve means and said shaft being rotatable relative to one another about the vertical axis of said shaft.

7. The system of claim 6 wherein said sleeve means includes adjustment means therewith for adjusting the vertical position of said mounted sleeve means with respect to said shaft through a limited range when said projecting portion is inserted in a socket assembly in a preformed structural component.

8. The system of claim 7 wherein said adjustment means is operable when said projecting portion is inserted in a socket assembly in a preformed structural component to position said sleeve means in abutment with said key means, said adjustment means being further operable to cause said sleeve means to act upon said key means and the projecting portion of which said key means is a part to prevent further movement of said carrier assembly along said guidance means.

9. The system of claim 8 wherein said guidance means includes channel means having first and second side wall portions each having an inwardly projecting flange near the top thereof, said flange defining a longitudinal slot therebetween, said carrier assembly being insertable into said channel means and said roller means thereof being positionable beneath said flanges, the action of said sleeve means upon said key means by operation of said adjustment means causing said roller means to be drawn into tight clamping engagement with said flanges.

10. The system of claim 7 wherein said sleeve means is exteriorly threaded along at least a portion thereof.

11. The system of claim 6 wherein said key means includes a pair of outer key portions and a spring portion therebetween biasing said outer key portions outwardly, said key assembly being compressible, said outer key portions having upper corners beveled to facilitate the slidable mounting of said sleeve means upon said shaft, said key assembly being compressed as it passes through said circular bore of said sleeve means during the mounting thereof upon said shaft, said outer key portions being biased outwardly following such mounting and adapted to retain said sleeve means upon said shaft.

12. The system of claim 6 wherein said carrier assembly includes first and second complementary body portions and connection means for connecting said body portions together.

13. The system of claim 12 wherein each of said body portions includes a portion of said shaft of the projecting portion of said carrier assembly and wherein said connection means includes a collar mountable over and around said shaft.

14. The system of claim 12 wherein said body portions are essentially identical.

15. A carrier assembly for use in a system for erecting walls and foundations upon a base support from preformed structural components, which system includes guidance means secured to the base support and wherein the preformed structural components have socket assemblies extending thereinto from the bases thereof, said carrier assembly comprising a base portion having roller means therewith engagable with the guidance means, a component engaging portion projecting upwardly from said base portion and being insertable into and engagable with a socket assembly of a structural component, and adjusting means operable for adjusting the engagement between said carrier assembly and the structural component, said carrier assembly being movable along the guidance means to a desired location when a structural component is engaged thereby, said adjusting means being further operable when said carrier assembly has been moved to a desired location to prevent further movement of said carrier assembly and engaged structural component and to secure such assembly and engaged component at such desired location.

16. The carrier assembly of claim 15 wherein the system guidance means includes channel means having a base and oppositely disposed inwardly projecting top flanges defining a slot therebetween and wherein said carrier assembly includes a pair of complementary body portions each forming a portion of said carrier assembly base portion and having roller means therewith and being individually insertable through the slot in the channel means and positionable in side-by-side abutment with one another with said roller means thereof disposed beneath the flanges, and including connection means for maintaining said body portions in side-by-side abutment.

17. The carrier assembly of claim 16 wherein said panel engaging portion includes a stud assembly and said connection means includes a collar mountable upon and around said stud assembly.

18. The carrier assembly of claim 17 wherein said stud assembly includes an essentially cylindrical shaft having a keyway therethrough near its distal end and a normally outwardly biased inwardly compressible key assembly insertable therein, said key assembly having beveled upper outer edges, and including a sleeve member adjustably engagable into a socket assembly of a structural component, said sleeve member having a central bore therethrough and being slidably mountable upon and around said shaft to compress said key assembly and to slidingly pass downwardly thereby, said key assembly including means for outwardly biasing said key assembly subsequent to the downward passage of said sleeve and for thereafter preventing upward passage of said sleeve past said key assembly.

19. The carrier assembly of claim 18 wherein the socket assemblies of the preformed structural components are interiorly threaded and wherein said sleeve member is exteriorly threaded to cooperatively engage an interiorly threaded socket assembly of a structural component.

20. The carrier assembly of claim 19 wherein said sleeve member when engagably inserted in a socket assembly of a structural component and mounted upon and around said shaft is rotatably adjustable to engage and act upon said key assembly to effect the elevation of said roller means off of the base of the channel means and into tight clamping engagement with the flanges of the channel means.

21. The carrier assembly of claim 17 wherein said stud assembly includes an essentially cylindrical shaft having a keyway therethrough near its distal end and including a sleeve member mountable upon and around said shaft, a key member insertable into said keyway to prevent subsequent upward passage of said mounted sleeve member past said key member, said mounted sleeve member being adjustably engagably insertable into a socket assembly of a structural component.

22. The carrier assembly of claim 21 wherein the socket assemblies of the preformed structural components are interiorly threaded and wherein said sleeve member is exteriorly threaded to cooperatively engage an interiorly threaded socket assembly of a structural component.

23. The carrier assembly of claim 22 wherein said sleeve member when mounted upon and around said shaft and engagably inserted in a socket assembly of a structural component is rotatably adjustable to engage and act upon said key assembly to effect the elevation of said roller means off of the base of the channel means and into tight clamping engagement with the flanges of the channel means.

24. A carrier assembly for use in a system for erecting walls and foundations upon a base support from preformed structural components, which system includes guidance means secured to the base support and wherein the preformed structural components have socket assemblies extending thereinto from the bases thereof, said carrier assembly comprising a pair of like body members adapted to be engagable with one another when in side-by-side abutment with one another, each body member having one substantially flat side surface and an opposite side having roller means which extend below the lowermost portion of said body member associated therewith, each body member having an elongated portion projecting vertically therefrom, said elongated portion having a semi-circular cross-section, said elongated members defining a cylindrical stud when the body members are in side-by-side abutment with the substantially flat sides thereof adjacent to one another, a sleeve mountable upon and around said cylindrical stud, said sleeve sized for rotatable movement between the sleeve and the stud, said sleeve including engaging means therewith for engaging a structural component to be moved and anchored by the assembly, and retaining means for retaining the sleeve around said cylindrical stud.

25. The carrier assembly of claim 24 wherein said sleeve is exteriorly threaded along at least a portion thereof.

26. The carrier assembly of claim 24 including a bearing collar mountable upon and around the cylindrical shaft below said sleeve.

27. A system for moving and anchoring structural components on foundation footings comprising a track on the footings, carrier means positionable on and movable along the track, said carrier means including means for connecting such carrier means to a structural component to be moved and anchored on the footings, said connecting means including means operable to engage the base portion of such structural component and to maintain such component independent of other support in an essentially upright position mounted upon said carrier means, said carrier means adapted to bear and temporarily support the weight of such mounted structural component during movement of said carrier means to a selectable desired location along said track, said operable means including for securing the carrier means and mounted structural component in place at the desired location along the track, and permanent support means engagable with the structural component and the footings when the structural component has been moved to the desired location to permanently support the structural component in place on the footings, said permanent support means being independent of said carrier means and said securing means.

28. The system of claim 27 wherein the track includes a bottom and opposed side walls each having an inwardly directed flange member near its top, said track having a continuous trough along the length thereof and an opening to the trough between the flange members.

29. The system of claim 28 wherein said carrier means includes roller means positioned in the open trough along the track, and wherein said connecting means projects upwardly through the opening between the flanges of the track for connection with a structural component.

30. The system of 27 wherein the permanent support means includes threaded members insertable in the base of a component and operable to be moved into contact with the footings.

31. A system for erecting walls and foundations upon a base support comprising a plurality of preformed structural components having interiorly threaded socket assemblies extending thereinto from the bases thereof, guidance means secured to the base support, a plurality of carrier assemblies engagable with the guidance means and movable therealong when engaged therewith, each of said carrier assemblies including component engaging means for engaging a structural component, said component engaging means including a stud portion, an exteriorly threaded sleeve member adjustably insertable into said socket assemblies of said structural components, said sleeve member having a central bore therethrough, said stud portion insertable through said central bore to project therebeyond, and retaining means for retaining said sleeve member upon and around said stud portion, said carrier assembly and engaged structural component being movable along said guidance means to a desired location when said sleeve member is retainably mounted upon and around said shaft and adjustably inserted in said socket assembly, said sleeve member being rotatable when said carrier assembly and engaged structural component are positioned at the desired location to inhibit further movement of said carrier assembly along said guidance means and to secure said carrier assembly and engaged structural component in place.

32. The system of claim 31 wherein said structural components include a plurality of interiorly threaded cavities extending into the bases thereof, and including a plurality of threaded leveling and support members adapted to be threadably insertable into said cavities and rotatably adjustable to level and support said structural components.

33. The system of claim 32 wherein said structural components have a socket assembly positioned adjacent each opposite end thereof.

34. A method for erecting walls and foundations, comprising the steps of:

(1) providing a stable base support;

(2) providing guidance means secured to the base support;

(3) providing preformed structural components;

(4) providing a plurality of carrier assemblies engaged with the guidance means, each of which carrier assemblies includes:

(a) a base portion having roller means engagable with the guidance means to permit movement of the carrier assembly along the track assembly;

(b) component engaging means for engaging a structural component; and (c) adjusting means operable to adjust the engagement between the carrier assembly and the engaged structural component, the adjusting means being further adjustable to inhibit movement of the carrier assembly along the guidance means and to thereby lock the carrier assembly and a structural component engaged therewith in place;

(5) positioning a structural component to permit it to be engaged near each of its opposite ends by a carrier assembly;

(6) effecting engagement between the structural component and the carrier assemblies;

(7) moving and positioning the carrier assemblies and the engaged structural component to a desired position along the guidance means;

(8) adjusting the adjusting means of each of the carrier assemblies engaging the structural component being moved to lock them and the engaged structural component in place;

(9) positioning and placing remaining structural components in accordance with steps (5) through (8); and

(10) sealing gaps between the base support and the structural components and between adjacent structural components with a suitable sealant.

* * * * *